US007114493B2

(12) United States Patent
Marsac

(10) Patent No.: US 7,114,493 B2
(45) Date of Patent: Oct. 3, 2006

(54) COMPRESSED GAS PUMP FOR REPLICA WEAPON

(75) Inventor: Bertrand Marsac, Le Logisson (FR)

(73) Assignee: Cybergun S.A., Cedex (FR)

( * ) Notice: Subject to any disclaimer, the term of this patent is extended or adjusted under 35 U.S.C. 154(b) by 21 days.

(21) Appl. No.: 11/009,924

(22) Filed: Dec. 10, 2004

(65) Prior Publication Data

US 2005/0183709 A1 Aug. 25, 2005

(30) Foreign Application Priority Data

Dec. 12, 2003 (FR) ..... 03 51032

(51) Int. Cl.
*F41B 11/00* (2006.01)

(52) U.S. Cl. ..... 124/63; 124/64; 124/65; 124/66

(58) Field of Classification Search ..... 124/56–74; 138/37, 39

See application file for complete search history.

(56) References Cited

U.S. PATENT DOCUMENTS 1,299,901 A * 4/1919 Blair ..... 124/76
3,958,550 A 5/1976 Johansson et al.
5,531,210 A 7/1996 Meiser et al.

FOREIGN PATENT DOCUMENTS

| | | |
|---|---|---|
| CH | 312734 | 2/1956 |
| DE | 1030735 | 5/1958 |
| DE | 1107560 | 5/1961 |

* cited by examiner

*Primary Examiner*—Michael J. Carone
*Assistant Examiner*—Gabriel J. Klein
(74) *Attorney, Agent, or Firm*—Boyle, Fredrickson, Newholm, Stein & Gratz, S.C.

(57) ABSTRACT

The invention concerns a pump for compressed gas for a replica weapon for the projection of balls, comprising:

A cylinder (7) forming a gas retention compartment (72) and provided with a cylinder head (71) forming a lateral wall of the said retention compartment, said cylinder head comprising a central orifice (73)

A gas ejection nozzle (9) having a first end opening into the retention compartment (72) and a second end opening into a barrel (1) of the replica weapon, and A piston (8) provided with a piston head (81) which is movable in the retention compartment and suitable for compressing the gas in the said compartment, in which, on the one hand, the piston head is conical in shape and, on the other, the cylinder head has the shape of a funnel, complementary to the conical shape of the piston head.

19 Claims, 3 Drawing Sheets

COMPRESSED GAS PUMP FOR REPLICA WEAPON

SCOPE OF THE INVENTION

The invention concerns a pump for compressed gas or air for a replica weapon for the projection of balls of the "Air Soft Gun®" or "Soft Air®" type. More precisely, the invention concerns the piston head and the cylinder head of the gas pump which are shaped, matched to one another, such as to ensure a better escape of the compressed air or gas towards the barrel of the replica weapon.

The invention finds applications in the sector of replica weapons, long or short-barrelled, operating with a spring with the compression of air or another gas, and manual or electrical arming. The invention applies, in particular, to replica weapons of which the projectiles are balls made of plastic material, very light in weight, of a diameter of about 6 mm.

PRIOR ART

In the sector of replica weapons, numerous models of firearms have been reproduced with the aim of playing games, for children or for adults. These replica weapons are generally of weapons which project, instead of the balls or lead bullets of real firearms, projectiles made of plastic such as balls of a diameter of the order of 6 millimetres. These plastic balls are ejected from the replica weapon by means of a pump for compressed air or gas. An example of a replica weapon equipped with a traditional compressed gas pump system is represented in FIG. 1. This replica weapon comprises, like all replica weapons:

- A weapon body, comprising in particular a cylinder and a piston, described hereinafter,
- A barrel 1, from which the ball 10 is projected,
- A stock 2 around which the player places his hand,
- A trigger guard 3 into which the player introduces his finger,
- A trigger 4, which can be moved inside the trigger guard and on which the player pulls in order to fire a plastic ball 10, and
- If the weapon is manually loaded, a loading button (not visible in FIG. 1), allowing the replica weapon to be reloaded with a new ball stored in a magazine 12.

When the player pulls the trigger 4, a gear system 5, in the body of the weapon, acts on the pump 6, which then evacuates the air or gas contained in the said pump towards the barrel 1 in such a way as to project the plastic ball out of the barrel of the replica weapon.

FIG. 2 represents a traditional pump system which is currently found in the majority of replica weapons. This pump system 6 comprises a cylinder 7, which forms the walls of a compartment 72 for retaining the gas. The cylinder 7 comprises a cylinder head 71, which forms a lateral wall, on the side facing the barrel 1 of the said compartment 72. This pump system 6 also comprises a piston 8 provided with a piston head 81. The piston is pushed by a compression spring 11 into the interior of the compartment 72, towards the head of the cylinder 71.

FIG. 2 shows two possible positions of the piston in the compartment 72: The upper part of the piston is shown in its closed position, i.e. when the piston is against the cylinder head and the lower part shows the open position of the piston, i.e. when the piston is retained by the compression spring 11. These two positions will be described in detail hereinafter.

The movement of the piston head 81, incurred by the piston assembly 8, towards the cylinder head 71, ensures a compression of the gas which is in the compartment 72. This compressed gas, which then seeks to escape from the compartment 72, expands into an ejection end piece or nozzle 9, connecting the cylinder head 71 and the barrel 1. This end piece or nozzle 9 is generally cylindrical and located in the interior of the central orifice 73 of the cylinder head. It has a diameter at the most equal to that of the balls, in such a way that the balls cannot pass into the end piece or nozzle. This end piece may be of different shapes, depending, in particular, on the model of the replica weapon, such as, for example, depending on whether it is an electrically or manually actuated weapon.

In the case of electrically actuated replica weapons, the end piece or nozzle 9 comprises a fixed part 9*a* which is of one piece with the cylinder head 71 and a movable part 9*b* connected to the actuating fork of the loading end piece, which ensures the forwards/backwards movement. This fork is itself actuated by a lug which is located on one of the toothed wheels of the gear system, and a return spring. Accordingly, before the piston head can come in contact with the cylinder head, the moving part 9*b* of the end piece or nozzle 9 is pushed towards the barrel 1, which pushes the ball located at the head of the magazine towards the entrance of the barrel in the barrel joint. In parallel with this, the gas evacuated from the compartment 72 crosses the end piece or nozzle 9, reaches the ball, and propels it out of the barrel.

In the manually-actuated models, the end piece 9 is totally fixed in position, but the pump is movable (because it is located in the interior of the breech, which is movable), the loading of the ball into the barrel is effected in the same way. The ball is then propelled out of the barrel in the same way, under the effect of the gas.

In other words, when the piston 8 is in the open position, i.e. the compression spring 11 is compressed, holding the piston 8 towards the rear of the weapon (i.e. towards the stock, at the opposite end to the barrel), the compartment 72 then has a large space, and the gas which is in this space is decompressed. When the compression spring 11 is decompressed, freed as a result of the action on the trigger, it pushes the piston 8 into the cylinder 7 towards the cylinder head 71, i.e. into a closed position, so reducing the volume of the compartment 72 and therefore creating the compressed gases which, being evacuated through the end piece or nozzle 9, eject the ball. The piston 8 is then moved by a rack-and-pinion arrangement 84 towards the rear again, so compressing the spring such as to prepare for the following shot. This movement of the piston 8 has the effect of compressing the gas in the compartment 72.

In a traditional gas pump, such as that of FIG. 2, the cylinder head 71 is flat. It comprises, in its centre, an orifice 73 for the evacuation of the gas, in which is located an end of the ejection end piece or nozzle 9. The gas which is compressed by the piston 8 in the compartment 72 then escapes from the said compartment through this nozzle 9. The shape of the piston head 81 is matched to the shape of the cylinder head 71. The piston head 81 is therefore flat, like the cylinder head. In the closed position, the piston head 81 and the cylinder head 71 are therefore in mechanical contact with one another.

Because the piston head and the cylinder head are flat, the flow of compressed air escapes from the compartment in a random fashion. In other words, when the piston head approaches the cylinder head, the flow of compressed gas has difficulty in escaping through the nozzle 9, the dimension of which is small in front of the flat parts of the piston head and cylinder head. In effect, due to the drastic reduction in diameter at the outlet of the gas flow towards the barrel in relation to the substantially greater diameter of the cylinder, the greatest part of the compressed gas is blocked against the wall which is formed by the flat cylinder head. The gas flow seeks to escape through the ejection nozzle 9, but it has difficulty because it creates substantial contradictory turbulence movements. This phenomenon is all the more important, the greater the difference between the diameter of the cylinder and the diameter of the ejection nozzle. In effect, if the size of the pump is increased in such a way as to increase the quantity of compressed gas in the compartment, and therefore the force with which the ball is propelled is increased, the diameter of the ejection nozzle is nevertheless not increased, because this diameter is a function of the diameter of the ball. Accordingly, the more the diameter of the pump is increased, the greater the disproportion between the size of the ejection nozzle and the flat surface of the piston head and cylinder head. As a consequence, the piston is slowed down as it approaches the cylinder head, which incurs appreciable losses to the delivery from the pump. The losses due to the flat parts of the pump are therefore greater, in proportion, if the dimensions of the pump are large.

To overcome this problem, manufacturers generally choose to use a stronger compression spring, i.e. of greater stiffness, in such a way as to compensate for the losses due to turbulence. This spring of greater stiffness, however, requires a greater application force on the loading button.

It is for this reason that spring-actuated replica weapons with manual loading present a genuine problem to users who are not particularly strong, and to women in particular, or to children if this involves models which are classified as "toys". In effect, these latter persons have difficulty in loading the weapon because the spring is stiff, which may incur problems with firing and even jamming.

With regard to electrically-actuated automatic replica weapons, it is the motor which suffers most due to the presence of a spring with a high degree of stiffness. This then requires a more powerful motor, which consumes more current. This motor is powered by a battery, the size of which is limited by the space available for the battery in the replica weapon. The independence of the motor of the replica weapon is therefore substantially reduced by the use of a spring of substantial stiffness. In addition, the reduction gear arrangement, composed of several pinions and toothed wheels, becomes fatigued very quickly, and the teeth end up by breaking off.

EXPLANATION OF THE INVENTION

The invention is specifically intended to rectify the disadvantages of the prior art. To this end, the invention proposes a compressed air or gas pump in which the piston head has a conical shape which engages in the cylinder head, the shape of which is matched to that of the piston head. The cylinder head forms a funnel, which allows the compressed gas to be directed towards the central orifice of the cylinder head, and therefore towards the ejection nozzle. The funnel shape of the cylinder head, associated with the conical shape of the piston head, allows for the resistance to be reduced considerably which is encountered by the gas seeking to escape from the gas retention compartment through the ejection nozzle.

More precisely, the invention concerns a gas pump for a replica weapon for the projection of balls, comprising:

A cylinder forming a gas retention compartment and provided with a cylinder head forming a lateral wall of the said retention compartment, the said cylinder head comprising a central orifice, A gas ejection nozzle, having a first end opening into the gas retention compartment and a second end opening into a barrel of the replica weapon, and A piston provided with a movable piston head in the gas retention compartment and suitable for compressing the gas in the said compartment.

This pump is characterised by the fact that, on the one hand, the piston head is conical in shape and, on the other, the cylinder head is funnel-shaped, complementary to the conical shape of the piston head.

To advantage, the gas pump according to the invention may comprise one of the following characteristics:

The cylinder head comprises gas deflection wings,

The piston head comprises slots suitable for accommodating the wings of the cylinder head, The gas pump comprises a damping joint located between the cylinder head and the piston head, The damping joint is toric in shape, The gas pump comprises a toric sealing joint between a first and second flange of the piston head, The piston head comprises an assembly screw bolt crossing the piston head from one side to the other and ending in an assembly nut, and The nut comprises a rotation blocking catch which is inserted into a flange of the piston head.

DETAILED DESCRIPTION OF EMBODIMENTS OF THE INVENTION

In the compressed air or gas pump according to the invention, the cylinder head and the piston head are of shapes which facilitate the thrust of the compressed gas towards the ejection nozzle. In the remainder of this description, a compressed air pump will be described, it being understood that any other gas customarily used in the pumps of replica weapons can also be used in the pump according to the invention.

Figure 3:
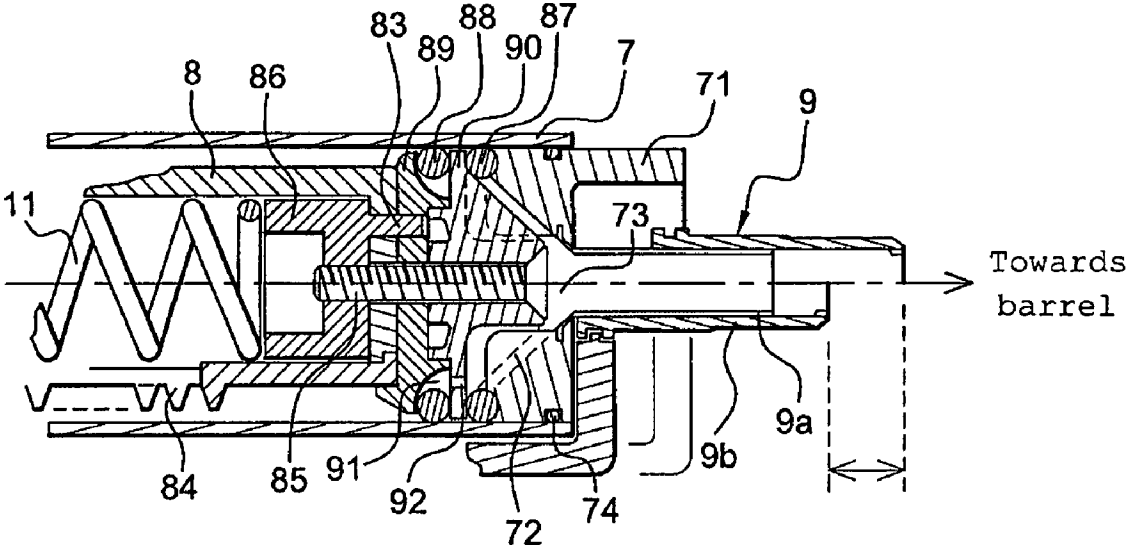
FIG. 3 represents a sectional view of a compressed gas pump according to the invention.

FIG. 3 represents a sectional view from the side of the compressed air pump according to the invention. This FIG. 3 shows a cylinder 7 forming a compartment 72 for retaining air. This cylinder 7 is provided with a cylinder head 71, in the centre of which an orifice 73 allows for the evacuation of the air towards the barrel of the replica weapon. One end of an ejection nozzle 9, identical to that of the prior art, is located in the vicinity of this central orifice 73. This FIG. 3 likewise shows a piston 8 which can be moved in the interior of the compartment 72.

According to the invention, the piston 8 has a conical piston head 81, i.e. it has the shape of a cone of which the top is oblate. The cylinder head 71 is funnel-shaped. In other words, the cylinder head forms a conical neck of which the centre is the orifice 73. The shape of the piston head 81 is formed such as to fit into the funnel shape of the cylinder head 71.

The cylinder head 71 is fixed in the cylinder 7. It comprises a central orifice 73. The ejection nozzle 9, according to the invention, comprises a first end which crosses the orifice 73 to open into the compartment 72. This first end is located in the cylinder head, in the vicinity of the said orifice 73. The second end opens into the barrel of the replica weapon. In the embodiment according to the invention, the nozzle 9 is inserted into the cylinder head by being moulded on.

As with the prior art, the ejection nozzle 9 is intended to allow the compressed air to pass from the air compression compartment 72 as far as the barrel, in which a plastic ball is waiting to be expelled. In the case of a manually-operated replica weapon, the flow of compressed air ensures the expulsion of the ball.

In the case of an electrically-operated replica weapon, the ejection nozzle is movable, with the loading of the ball being carried tout by a movement of this nozzle caused by the loading fork. This movement is represented in FIG. 3 by arrows. In the case of an electric model, the movement of the ejection nozzle, also referred to as the loading nozzle, allows for the ball to be pushed into the barrel at the moment of firing.

The cylinder head 71 is sealed against the air, in the interior of the cylinder 7, by means of a toric joint 74 placed in a mounting of the cylinder head.

The piston head 81 comprises a first flange 89 and a second flange 90. The second flange 90 is conical in shape. It is this flange which is in contact with the compressed air. The oblate top of the cone of the second flange, located opposite the orifice 73 of the cylinder head, allows for the maximum direction of the compressed air towards the central orifice of the cylinder head. The first flange 89 is located to the rear of the second flange. It serves as an interface between the piston head 81 and the other elements of the piston 6. In particular, the first flange 89 is fixed on the rack-and-pinion arrangement 84 for actuating the piston.

A bolt 85 crosses the second flange 90 and the first flange 89. This bolt 85 is screwed into a nut 86, against which the spring 11 is supported. This bolt 86 comprises a rotation-blocking catch 83, which is inserted into the first flange 89 of the piston. This blocking catch 83 allows for any rotation of the piston 8 to be avoided in the interior of the cylinder 7.

A toric joint 88, located between the first flange 89 and the second flange 90 of the piston, ensure the seal between the piston and the cylinder. This toric joint 88 is placed in a mounting 91 formed in the first flange 89, the volume of which is greater than the diameter of the joint. Accordingly, when the piston head approaches the cylinder head, a little of the compressed air from the compartment 72 passes into the mounting 91 of the toric joint, via passage holes 92. This has the effect of flattening the joint towards the outside, i.e. against the cylinder 7, which ensures the sealing between the piston head and the cylinder, avoiding any emergence of air to the rear of the piston head.

According to the invention, the pump system likewise comprises a damper element 87 located between the piston head 81 and the cylinder head 71. This damper element 87 can be a toric joint. It has the purpose of damping the contact between the piston head and the cylinder head at the moment at which the piston head comes in contact with the cylinder head. In fact, taking account of the shape of the cylinder head and the piston head, the compressed air passes very rapidly into the ejection nozzle, which means that the speed of the piston arriving on the cylinder head is relatively high. This damper element, or damping joint, 87, allows for violent mechanical contact to be avoided between the piston head and the cylinder head, which might damage one or the other of the heads. The damping joint 87 accordingly ensures a minimum distance necessary between the cylinder head and the piston head in order to avoid a shock caused by the piston head on the cylinder head.

Accordingly, with the compressed air pump according to the invention, when the user pulls the trigger of the replica weapon, the spring causes the piston head to move towards the cylinder head. The air present in the air retention compartment 72 is then compressed. Due to the shape of the piston head and the cylinder head, the compressed air flow is directed directly towards the orifice 73 and therefore towards the ejection nozzle 9. The air flow is therefore concentrated into one overall mass towards the centre of the cylinder head.

Figure 4A:
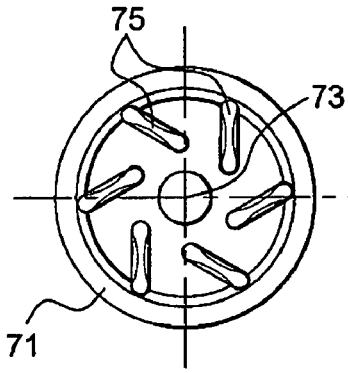
FIGS. 4A and 4B represent sectional views, from the face and side respectively, of the cylinder head of the gas pump according to the invention.
Figure 4B:
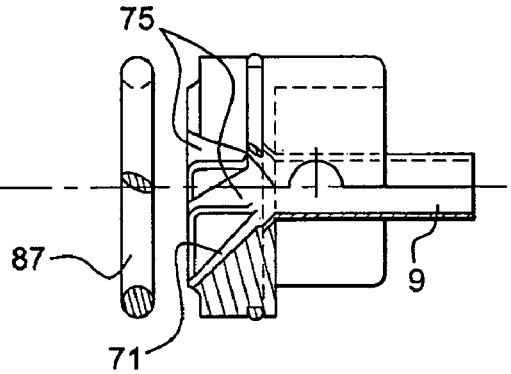

This pump therefore allows for the resistance to be considerably reduced which is encountered by the air when it escapes through the ejection nozzle. This resistance is further reduced by using means intended to cause turbulence in the air flow towards the ejection nozzle. These means consist of wings placed on the surface of the cylinder head. The piston head therefore comprises slots or recesses to accommodate these wings, i.e. to form a casing around the wings, when the piston head is close to the cylinder head. FIGS. 4A and 4B represent sectional views of the cylinder head according to the invention. More precisely, FIG. 4B shows a sectional view of the cylinder head. In this Figure can be seen the ejection nozzle 9 which ends in the central orifice 73 of the cylinder head 71. In the embodiment from FIG. 4B, the cylinder head comprises wings 75, which are intended to cause turbulence in the air flow towards the central orifice and therefore towards the ejection nozzle. This figure likewise shows the toric joint 87, placed in front of the cylinder head in such a way that the piston head and the cylinder head cannot come into direct contact with one another when the whole of the compressed air has been evacuated.

FIG. 4A shows a sectional view of the face of the cylinder head 71. In this Figure can be seen the cylinder head 71 on which are fixed various different wings 75. In the case of FIG. 4A, these wings are six in number. Their number, shape, and placement are chosen in such a way as to incur turbulence in the flow of compressed air towards the centre of the cylinder head, i.e. towards the orifice 73. These wings can be fixed on the cylinder head by any known means of fixation. They may also be moulded with the cylinder head.

Figure 5A:
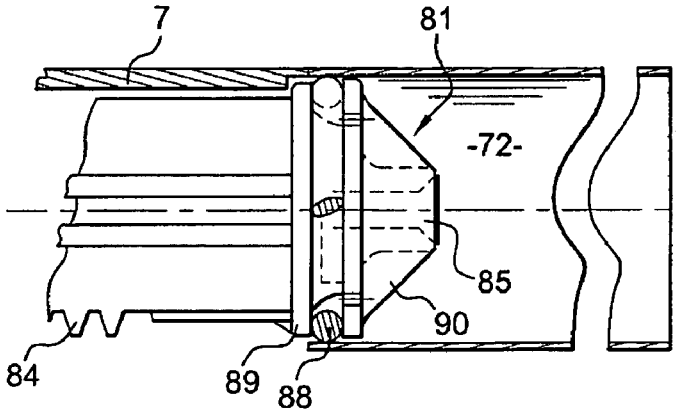
FIGS. 5A and 5B represent sectional views, from the face and side respectively, of the piston head of the gas pump according to the invention.

Represented in FIG. 5A is a sectional view from the side of the piston head according to the invention. This view shows the end of the piston head 81 with its second flange 90 in the shape of an oblate cone, and its first flange 89, both separated by a sealing joint 88. It likewise shows the assembly bolt 85 which crosses the piston head in order to hold the different elements of the piston together.

Figure 5B:
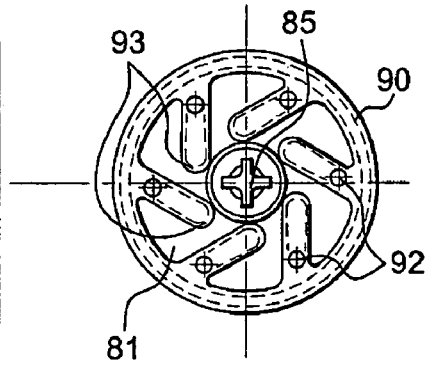

FIG. 5B shows a sectional view of the piston head 81. This FIG. 5B shows six slots 93, intended to accommodate the six wings of the cylinder head. These slots 93 have dimensions and shapes matched to surround and encase the wings. These slots are provided in the second flange 90, for example during the moulding of the said flange.

This FIG. 5B also shows six orifices 92 for the passage of air towards the sealing joint 88, one orifice being provided at the base of each slot 93. It is to be noted, moreover, that the number and placement of the air passage orifices may vary depending on the type of joint used and the model of the replica weapon.

Figure 1:
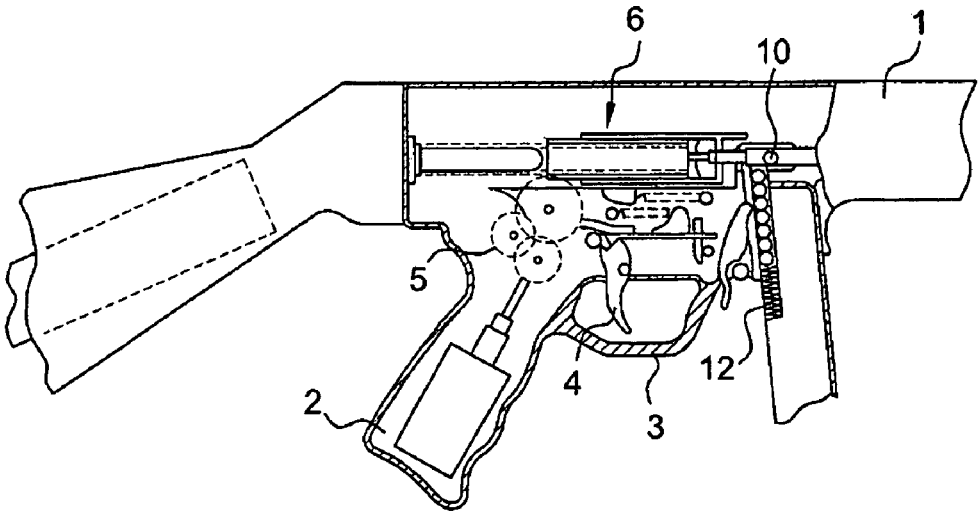
FIG. 1, already described, represents an embodiment of a traditional replica weapon.
Figure 2:
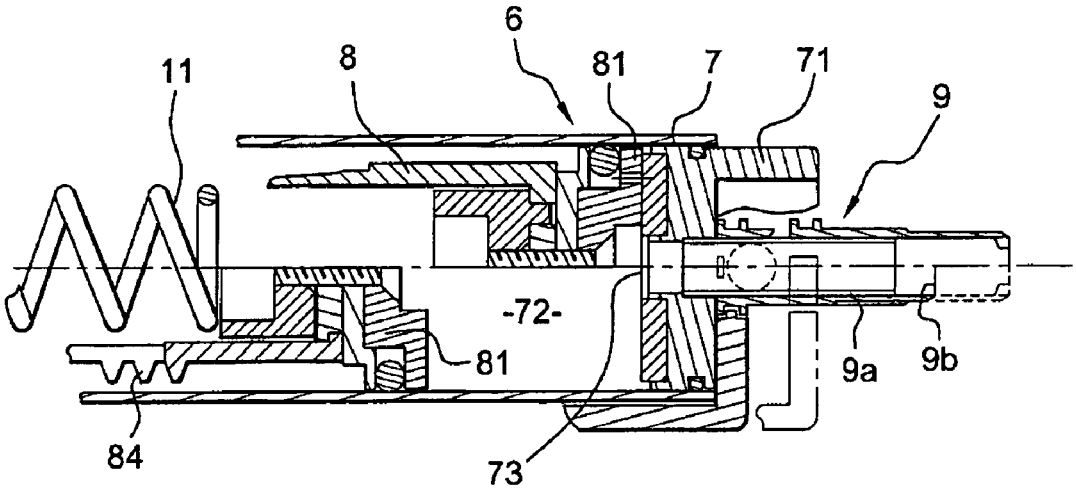
FIG. 2, already described, represents an embodiment of a traditional gas pump.
Figure 6:
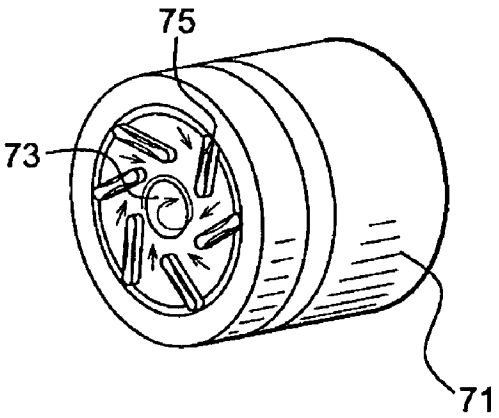
FIG. 6 represents a diagrammatical view of the centripetal turbulent flow obtained with the gas pump according to the invention.

FIG. 6 represents in diagrammatic form the air flow obtained in the interior of the cylinder head. This air flow is represented in diagrammatic form by arrows. As can be seen in FIG. 6, this flow of compressed air is directed by the wings 75 towards the centre of the cylinder head 71, which forms, in the vicinity of the central orifice 73, a turbulence which ensures a more rapid ejection of the air flow into the ejection nozzle. In effect, the compressed air between the wings 75 undergoes an increase in its speed and is turned while converging towards the centre of the cylinder head, so creating a centripetic turbulence which expands through the ejection nozzle, which appreciably increases the speed of the air and therefore the energy of the flow intended to propel the ball which is located at the entrance of the barrel.

The invention claimed is:

1. Gas pump for a replica weapon for the projection of balls, comprising:

a cylinder forming a gas retention compartment and provided with a cylinder head, forming a lateral wall of the said retention compartment, said cylinder head comprising a central orifice a gas ejection nozzle having a first end opening into the retention compartment and a second end opening into a barrel of the replica weapon, and a piston provided with a piston head which is movable in the retention compartment and suitable for compressing the gas in the said compartment, the piston head being conical in shape and the cylinder head being in the shape of a funnel, complementary to the conical shape of the piston head, and wherein the cylinder head comprises means to cause turbulence in the flow of gas towards the ejection nozzle.

2. Gas pump for a replica weapon according to claim 1, wherein the means for causing turbulence in the gas flow comprise wings.

3. Gas pump for a replica weapon according to claim 2, wherein the piston head comprises slots capable of receiving the wings of the cylinder head.

4. Gas pump for a replica weapon according to claim 1, further comprising a damping joint placed between the cylinder head and the piston head.

5. Gas pump for a replica weapon according to claim 4, wherein the damping joint is toric.

6. Gas pump for a replica weapon according to claim 1, further comprising a toric sealing joint located between a first and second flange of the piston head.

7. Gas pump for a replica weapon according to claim 1, wherein the piston head comprises an assembly bolt crossing the piston head from one side to the other and ending in an assembly nut.

8. Gas pump for a replica weapon according to claim 7, wherein the bolt comprises a rotation blocking catch, inserted into one of the flanges of the piston head.

9. A gas pump for a projectile firing toy weapon comprising: a cylinder in gas flow communication with a barrel of the toy weapon; a piston used to compress gas in the cylinder that gets communicated to the barrel of the toy weapon; and a turbulent flow inducer disposed in the cylinder that induces turbulence in gas communicated to the barrel of the toy weapon wherein the turbulent flow inducer comprises a plurality of fins.

10. A projectile firing toy weapon gas pump according to claim 9 wherein the fins are fixed relative to the cylinder.

11. A projectile firing toy weapon gas pump according to claim 9 wherein the cylinder comprises a cylinder head disposed between the piston and the barrel of the toy weapon, a port is used to communicate compressed gas from the cylinder to the barrel of the toy weapon, and the plurality of fins are arranged to swirl compressed gas entering the port.

12. A projectile firing toy weapon gas pump according to claim 11 wherein the plurality of fins are carried by one of the piston and the cylinder head.

13. A projectile firing toy weapon gas pump according to claim 12 wherein the plurality of fins are integrally formed of the cylinder head.

14. A projectile firing toy weapon gas pump according to claim 9 further comprising a cylinder head disposed between the piston and the barrel of the toy weapon, wherein the cylinder head has a port that enables compressed gas to flow from the cylinder to the barrel of the toy weapon, and wherein the piston and the cylinder head have opposed and complementary conic surfaces facing toward one another.

15. A projectile firing toy weapon gas pump according to claim 14 wherein the conic surface of the cylinder head is funnel shaped and the conic surface of the piston is generally frustoconical.

16. A projectile firing toy weapon gas pump according to claim 14 further comprising a damper disposed between the cylinder head and the piston.

17. A projectile firing toy weapon gas pump according to claim 9 wherein the piston comprises a seat in which an annular seal is received that provides a gas-tight seal between the piston and the cylinder.

18. A projectile firing toy weapon gas pump according to claim 17 wherein the annular seal is exposed to compressed gas in the cylinder such that compressed gas in the cylinder urges the annular seal against the cylinder facilitating sealing.

19. A gas pump for a projectile firing toy weapon comprising:

a cylinder comprising a cylinder head having a conduit through which gas from the cylinder is flowable into a barrel of the toy weapon in which a plastic projectile is disposed;

a piston received in the cylinder that is movable toward the cylinder head to compress gas in the cylinder that flows into the barrel of the toy weapon propelling the plastic projectile therefrom;

a turbulent flow inducer disposed between the cylinder head and the piston that induces turbulence in gas in the cylinder entering the conduit; and wherein the piston and the cylinder head each have a conic surface with the conic surface of the piston facing toward and being complementary with the conic surface of the cylinder head.

* * * * *